US008183462B2

(12) United States Patent
Nordin et al.

(10) Patent No.: US 8,183,462 B2
(45) Date of Patent: May 22, 2012

(54) COMMUNICATION CABLE WITH IMPROVED CROSSTALK ATTENUATION

(75) Inventors: Ronald A. Nordin, Naperville, IL (US); Masud Bolouri-Saransar, Orland Park, IL (US); Royal O. Jenner, Tinley Park, IL (US); Timothy J. Houghton, II, Chicago, IL (US); Thomas G. McLaughlin, Taylor Mill, KY (US); Kenneth E. Cornelison, Cincinnati, OH (US); David P. Camp, II, Florence, KY (US)

(73) Assignee: Panduit Corp., Tinley Park, IL (US)

( * ) Notice: Subject to any disclaimer, the term of this patent is extended or adjusted under 35 U.S.C. 154(b) by 346 days.

(21) Appl. No.: 12/467,855

(22) Filed: May 18, 2009

(65) Prior Publication Data

US 2009/0294146 A1 Dec. 3, 2009

Related U.S. Application Data

(60) Provisional application No. 61/054,330, filed on May 19, 2008.

(51) Int. Cl.
*H01B 7/00* (2006.01)

(52) U.S. Cl. ..... 174/102 R; 174/110 R; 174/113 R; 174/102 SP

(58) Field of Classification Search ..... 174/36, 174/110 R, 110 SP, 114 R, 114 S, 115
See application file for complete search history.

(56) References Cited

U.S. PATENT DOCUMENTS

| | | | | |
|---|---|---|---|---|
| 2,796,463 | A * | 6/1957 | Mallinckrodt | 178/45 |
| 3,312,774 | A | 4/1967 | Peterson | |
| 3,573,676 | A * | 4/1971 | Mayer | 333/202 |
| 3,794,750 | A | 2/1974 | Garshick | |
| 3,896,380 | A * | 7/1975 | Martin | 455/523 |
| 4,129,841 | A * | 12/1978 | Hildebrand et al. | 333/237 |
| 4,236,779 | A | 12/1980 | Tang | |
| 4,339,733 | A * | 7/1982 | Smith | 333/237 |
| 4,684,437 | A | 8/1987 | Donelon et al. | |
| 4,743,725 | A * | 5/1988 | Risman | 219/691 |
| 4,788,088 | A * | 11/1988 | Kohl | 428/34.5 |
| 5,132,488 | A | 7/1992 | Tessier et al. | |
| 5,465,395 | A * | 11/1995 | Bartram | 455/523 |
| 5,473,336 | A | 12/1995 | Harman et al. | |
| 5,969,295 | A | 10/1999 | Boucino et al. | |
| 6,639,152 | B2 | 10/2003 | Glew et al. | |
| 6,818,832 | B2 | 11/2004 | Hopkinson et al. | |
| 7,332,676 | B2 * | 2/2008 | Sparrowhawk | 174/102 R |
| 7,335,837 | B2 | 2/2008 | Pfeiler et al. | |
| 2004/0055781 | A1 | 3/2004 | Cornibert et al. | |
| 2005/0199415 | A1 * | 9/2005 | Glew | 174/113 C |
| 2006/0048961 | A1 * | 3/2006 | Pfeiler et al. | 174/36 |
| 2006/0048964 | A1 * | 3/2006 | Rick | 174/66 |
| 2006/0169478 | A1 | 8/2006 | Clark | |
| 2007/0037419 | A1 | 2/2007 | Sparrowhawk | |
| 2009/0223694 | A1 | 9/2009 | Nordin et al. | |

FOREIGN PATENT DOCUMENTS

| | | |
|---|---|---|
| JP | S6317192 U | 11/1988 |
| WO | 2006105166 | 10/2006 |

* cited by examiner

*Primary Examiner* — William Mayo, III

(74) *Attorney, Agent, or Firm* — Robert A. McCann; Christopher S. Clancy; Christopher K. Marlow

(57) ABSTRACT

A barrier tape used as part of a communication cable is described. The barrier tape is provided with one or more barrier layers of discontinuous conductive segments. Conductive segments of one barrier layer are preferably sized and shaped to overlie gaps between conductive segments of another barrier layer.

19 Claims, 4 Drawing Sheets

COMMUNICATION CABLE WITH IMPROVED CROSSTALK ATTENUATION

CROSS-REFERENCE TO RELATED APPLICATIONS

This application claims the benefit of U.S. Patent Application No. 61/054,330, filed May 19, 2008. This application is incorporated herein by reference in its entirety.

FIELD OF THE INVENTION

The present invention relates to communication cables, and more particularly to methods and apparatus to enhance the attenuation of crosstalk associated with such cables.

BACKGROUND OF THE INVENTION

As networks become more complex and have a need for higher bandwidth cabling, attenuation of cable-to-cable crosstalk (or "alien crosstalk") becomes increasingly important to provide a robust and reliable communication system. Alien crosstalk is primarily coupled electromagnetic noise that can occur in a disturbed cable arising from signal-carrying cables that run near the disturbed cable. Additionally, crosstalk can occur between twisted pairs within a particular cable, which can additionally degrade a communication system's reliability.

SUMMARY OF THE INVENTION

In some embodiments, the present invention relates to the use of multiple layers of material having conductive segments as a method of enhancing the attenuation of alien crosstalk. In one embodiment, the present invention comprises a double-layered metal patterned film (or barrier tape) that is wrapped around the wire pairs of a high performance 10 Gb/s (gigabit/second) unshielded twisted pair (UTP) cable. In general, the present invention can be used in communication cable of higher or lower frequencies, such as (TIA/EIA standards) Category 5e, Category 6, Category 6A, Category 7, and copper cabling used for even higher frequency or bit rate applications, such as 40 Gb/s and 100 Gb/s. The conductive segments in the layers are positioned so that gaps in one layer are substantially overlain by conductive segments of a neighboring layer. The multiple layers reduce crosstalk while gaps between the conductive segments reduce the emission of electromagnetic energy from the conductive material and also reduce the susceptibility of the conductive material to radiated electromagnetic energy.

The present invention solves deficiencies in the prior art of UTP cable to reduce cable-to-cable crosstalk, or other types of crosstalk. Embodiments of the present invention may be applied to other types of cable in addition to UTP cable.

BRIEF DESCRIPTION OF THE DRAWINGS

For the purpose of facilitating an understanding of the inventions, the accompanying drawings and description illustrate embodiments thereof, from which the inventions, structure, construction and operation, and many related advantages may be readily understood and appreciated.

DETAILED DESCRIPTION OF THE EMBODIMENTS

Figure 1:
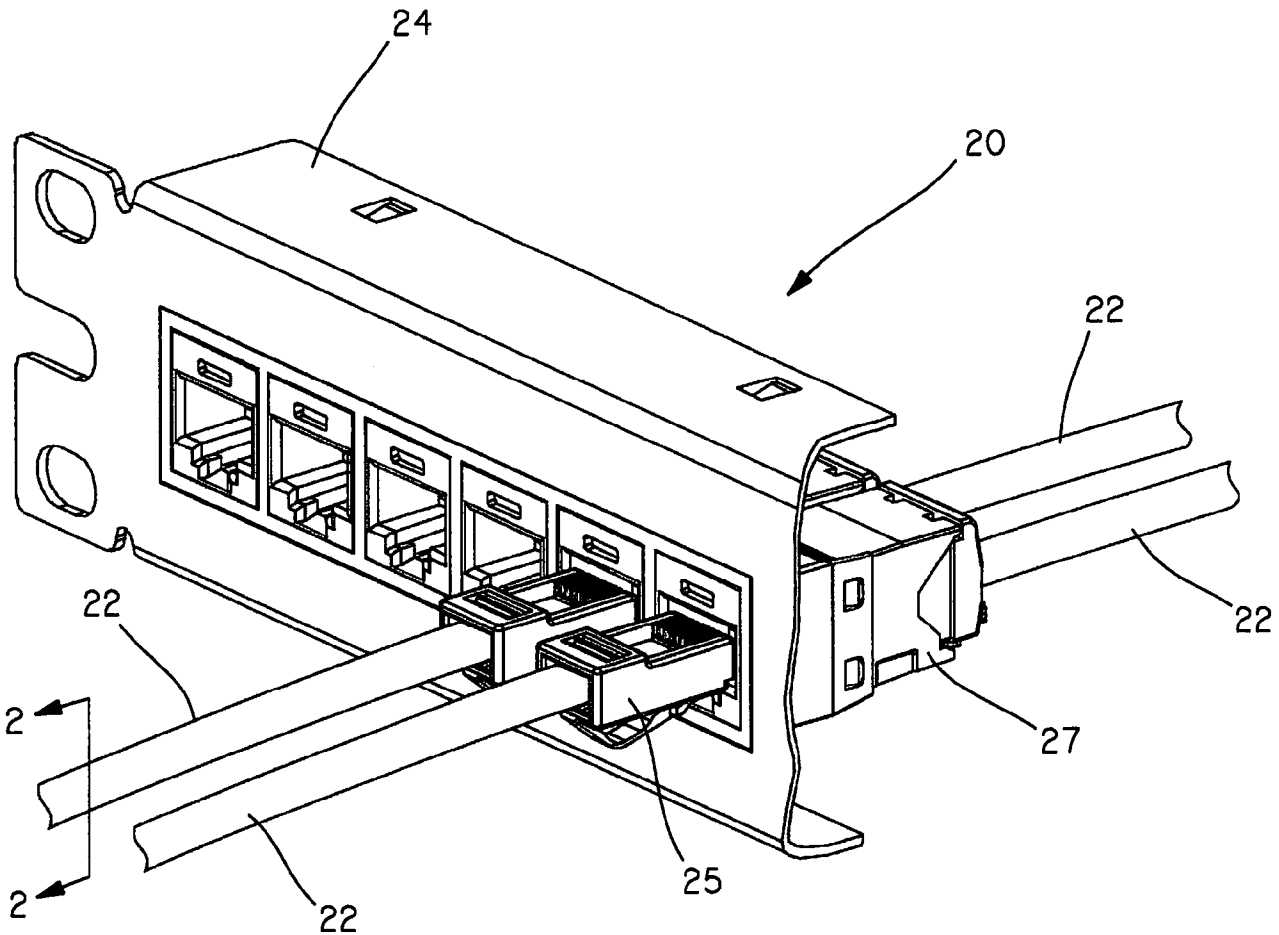
FIG. 1 is a perspective view of an embodiment of a communication system including multiple communication cables according to the present invention.

Referring now to the drawings, and more particularly to FIG. 1, there is shown a communication system 20, which includes at least one communication cable 22, connected to equipment 24. Equipment 24 is illustrated as a patch panel in FIG. 1, but the equipment can be passive equipment or active equipment. Examples of passive equipment can be, but are not limited to, modular patch panels, punch-down patch panels, coupler patch panels, wall jacks, etc. Examples of active equipment can be, but are not limited to, Ethernet switches, routers, servers, physical layer management systems, and power-over-Ethernet equipment as can be found in data centers/telecommunications rooms; security devices (cameras and other sensors, etc.) and door access equipment; and telephones, computers, fax machines, printers and other peripherals as can be found in workstation areas. Communication system 20 can further include cabinets, racks, cable management and overhead routing systems, for example.

Communication cable 22 is shown in the form of an unshielded twisted pair (UTP) cable, and more particularly a Category 6A cable which can operate at 10 Gb/s, as is shown more particularly in FIG. 2, and which is described in more detail below. However, the present invention can be applied to and/or implemented in a variety of communications cables, as well as other types of cables. Cables 22 can be terminated directly into equipment 24, or alternatively, can be terminated in a variety of plugs 25 or jack modules 27 such as RJ45 type, jack module cassettes, Infiniband connectors, RJ21, and many other connector types, or combinations thereof. Further, cables 22 can be processed into looms, or bundles, of cables, and additionally can be processed into preterminated looms.

Communication cable 22 can be used in a variety of structured cabling applications including patch cords, backbone cabling, and horizontal cabling, although the present invention is not limited to such applications. In general, the present invention can be used in military, industrial, telecommunications, computer, data communications, and other cabling applications.

Figure 2:
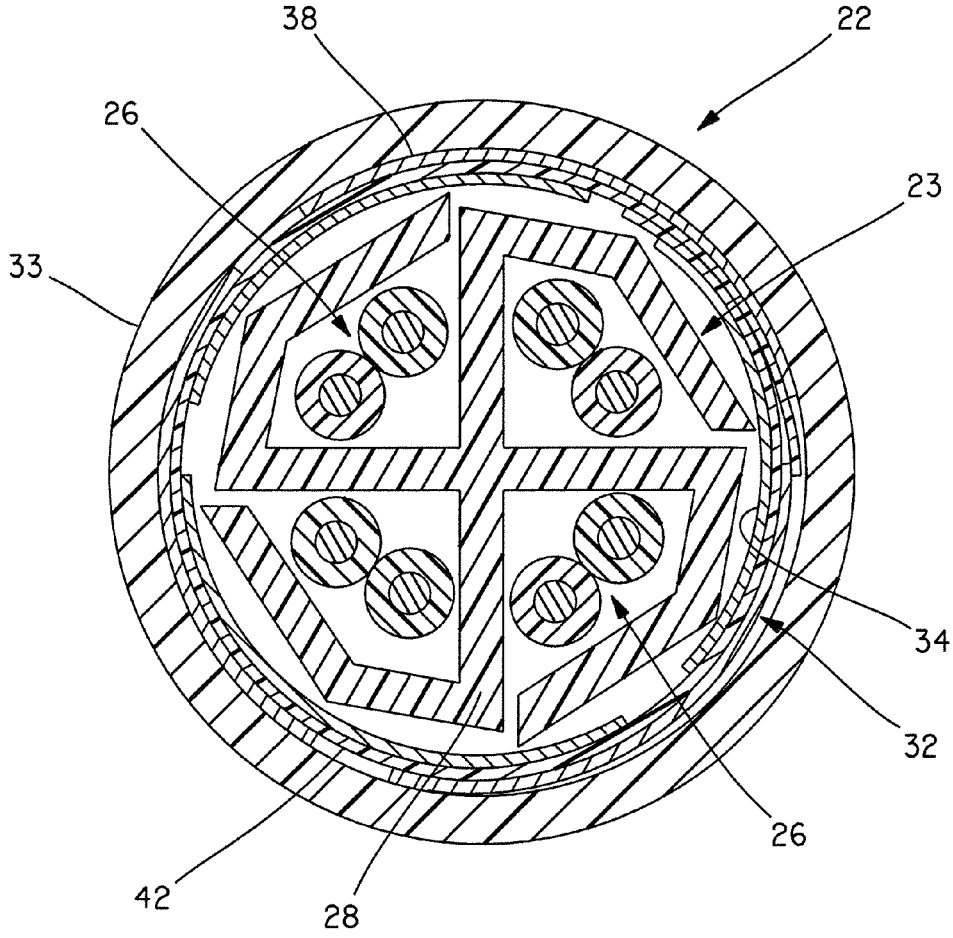
FIG. 2 is a cross-sectional view of one of the communication cables of FIG. 1.
Figure 3:
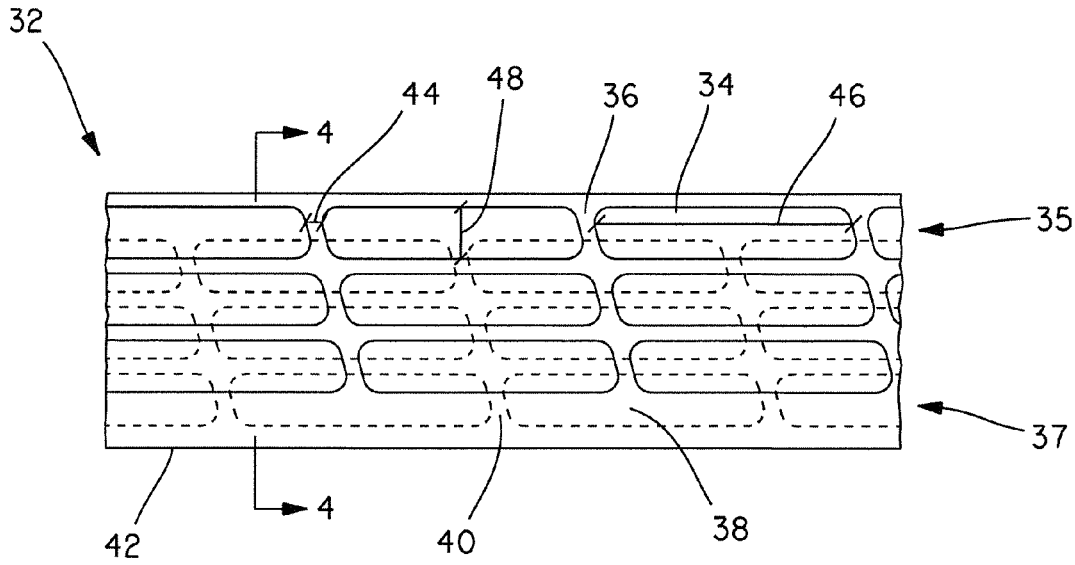
FIG. 3 is a fragmentary plan view of an embodiment of a barrier tape according to the present invention and used in the cables of FIGS. 1 and 2.
Figure 4:
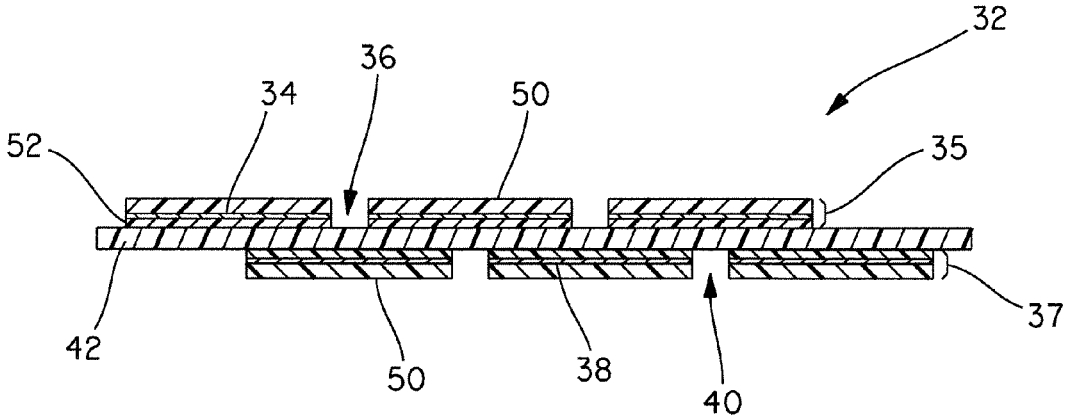
FIG. 4 is a cross-sectional view of the barrier tape of FIG. 3, taken along section 4-4 in FIG. 3.

Referring more particularly to FIG. 2, there is shown a transverse cross-section of cable 22, taken along section line 2-2 in FIG. 1. Cable 22 includes an inner core 23 of four twisted conductive wire pairs 26 that are separated with a crossweb 28. A wrapping of barrier tape 32 surrounds crossweb 28. Barrier tape 32 can be helically wound around crossweb 28. Cable 22 also can include an outer insulating jacket 33. The barrier tape 32 is shown in a condensed version for illustration in FIG. 2, showing only an insulating substrate 42 and conductive segments 34 and 38. Crossweb 28 includes a central "x" section which segregates the twisted pairs 26 from each other, and perimeter sections extending from the periphery of the "x" section which segregate the twisted pairs 26 from barrier tape 32. Referring also to FIGS. 3 and 4, barrier tape 32 includes a first barrier layer 35 (shown in FIG. 2 as an inner barrier layer) comprising conductive segments 34 separated by gaps 36; a second barrier layer 37 (shown in FIG. 2 as an outer barrier layer) comprising conductive segments 38 separated by gaps 40 in the conductive material of segments 38; and an insulating substrate 42 separating conductive segments 34 and gaps 36 of the first conductive layer from conductive segments 38 and gaps 40 of the second conductive layer. The first and second barrier layers, and more particularly conductive segments 34 and conductive segments 38, are staggered within the cable so that gaps 40 of the outer barrier layer align with the conductive segments 34 of the inner conductive layer. Barrier tape 32 can be helically or spirally wound around the inner insulating layer 30. Alternatively, the barrier tape can be applied around the insulative layer in a non-helical way (e.g., "cigarette" or longitudinal style).

Outer insulating jacket 33 can be 15 mil thick (however, other thicknesses are possible). The overall diameter of cable 22 can be approximately 300 mils, for example; however, other thicknesses are possible.

FIG. 3 is a plan view of barrier tape 32 illustrating the patterned conductive segments on an insulative substrate where two barrier layers 35 and 37 of discontinuous conductive material are used. The conductive segments 34 and 38 are arranged in a series of plane figures along both the longitudinal and transverse direction of an underlying substrate 42. As described, the use of multiple barrier layers of patterned conductive segments facilitates enhanced attenuation of alien crosstalk, by effectively reducing coupling by a cable 22 to an adjacent cable, and by providing a barrier to coupling from other cables. The discontinuous nature of the conductive segments 34 and 38 reduces or eliminates radiation from the barrier layers 35 and 37. In the embodiment shown, a double-layered gridlike metal pattern is incorporated in barrier tape 32, which spirally wraps around the twisted wire pairs 26 of the exemplary high performance 10 Gb/s cable. The pattern may be chosen such that conductive segments of a barrier layer overlap gaps 36, 40 from the neighboring barrier layer. In FIGS. 3 and 4, for example, both the top 35 and bottom 37 barrier layers have conductive segments that are arranged in a series of 15° parallelograms (with rounded corners) approximately 1071 mil×203 mil with a 60 mil gap size 44 between segments in both the horizontal and vertical directions as shown in FIG. 3. According to one embodiment, the rounded corners are provided with a radius of approximately 1/16".

Referring to the upper barrier layer 35, the performance of any single layer of conductive material is at least partially dependent on the gap size 44 of the discontinuous pattern and the longitudinal length 46 of the discontinuous segments and can also be at least somewhat dependent on the transverse widths 48 of the conductive segments. In general, the smaller the gap size 44 and longer the longitudinal length 46, the better is the cable-to-cable crosstalk attenuation. However, if the longitudinal pattern length 46 is too long, the layers of discontinuous conductive material can radiate and can be susceptible to electromagnetic energy in the frequency range of relevance. One solution is to design the longitudinal pattern length 46 so it is slightly greater than the average pair lay of the twisted conductive wire pairs within the surrounded cable but smaller than one quarter of the wavelength of the highest frequency signal transmitted over the wire pairs. The pair lay is equal to the length of one complete twist of a twisted wire pair.

Twisted pairs in a communication cable may be colored blue, orange, green, and brown. In the embodiment shown the twist lengths (i.e., pair lays) for four twisted conductive wire pairs are 0.828 cm for the blue pair, 1.204 cm for the orange pair, 0.897 cm for the green pair and 1.074 cm for the brown pair. Typical pair lays for high-performance cable (e.g., 10 Gb/s) are in the range of 0.8 cm to 1.3 cm. Hence the conductive segment lengths are typically within the range of from approximately 1.3 cm to approximately 10 cm for cables adapted for use at a frequency of 500 MHz. At higher or lower frequencies, the lengths will vary lower or higher, respectively.

Further, for a signal having a frequency of 500 MHz, the wavelength will be approximately 40 cm when the velocity of propagation is 20 cm/ns. At this wavelength, the lengths of the conductive segments of the barrier layers should be less than 10 cm (i.e., one quarter of a wavelength) to prevent the conductive segments from radiating electromagnetic energy.

It is also desirable that the transverse widths 48 of the conductive segments "cover" the twisted wire pairs as they twist in the cable core. In other words, it is desirable for the transverse widths 48 of the conductive segments to be wide enough to overlie a twisted pair in a radial direction outwardly from the center of the cable. Generally, the wider the transverse widths 48, the better the cable-to-cable crosstalk attenuation is. It is further desirable for the barrier tape 32 to be helically wrapped around the cable core at approximately the same rate as the twist rate of the cable's core. In the embodiment shown the cable strand lay is 7.62 cm. For high-performance cable (e.g., 10 Gb/s), typical cable strand lays (i.e., the twist rate of the cable's core) are in the range of from approximately 6 cm to approximately 12 cm. It is preferred that barrier tapes according to the present invention are wrapped at the same rate as the cable strand lay (that is, one complete wrap in the range of from approximately 6 cm to approximately 12 cm). However, the present invention is not limited to this range of wrap lengths, and longer or shorter wrap lengths may be used.

A high-performing application of a barrier tape of discontinuous conductive segments is to use one or more conductive barrier layers to increase the cable-to-cable crosstalk attenuation. For barriers of multiple layers, barrier layers are separated by a substrate so that the layers are not in direct electrical contact with one another. Although two barrier layers 35 and 37 are illustrated, the present invention can include a single barrier layer, or three or more barrier layers.

FIG. 4 illustrates a cross-sectional view, taken along section line 4-4 in FIG. 3, of barrier tape 32 in more detail as employed with two barrier layers 35 and 37. Each barrier layer includes a substrate 50 and conductive segments 34 or 38. The substrate 50 is an insulative material and can be approximately 0.75 mils thick, for example. The layer of conductive segments contains plane figures, for example parallelograms with rounded corners, of aluminum having a thickness of approximately 0.35 mils. According to other embodiments of the present invention, the conductive segments may be made of different shapes such as regular or irregular polygons, other irregular shapes, curved closed shapes, isolated regions formed by conductive material cracks, and/or combinations of the above. The present invention can combine different shapes in multiple rows of conductive segments. Other conductive materials, such as copper, gold, or nickel may be used for the conductive segments. Other conductive segment thicknesses could range from approximately 0.3 mils to approximately 1.5 mils. Semiconductive materials may be used in those areas as well. Examples of the material of the insulative substrate 50 include polyester, polypropylene, polyethylene, polyimide, and other materials.

The conductive segments 34 and 38 are attached to a common insulative substrate 42 via layers of spray glue 52. The layers of spray glue 52 can be 0.5 mils thick and the common layer of insulative substrate 42 can be 1.5 mil thick, for example. Given the illustrated example thicknesses for the layers, the overall thickness of the barrier tape 32 of FIG. 4 is approximately 4.7 mils. It is to be understood that different material thicknesses may be employed for the different layers. According to some embodiments, it is desirable to keep the distance between the two layers of conductive segments 34 and 38 small so as to reduce capacitance between those layers.

Figure 5:
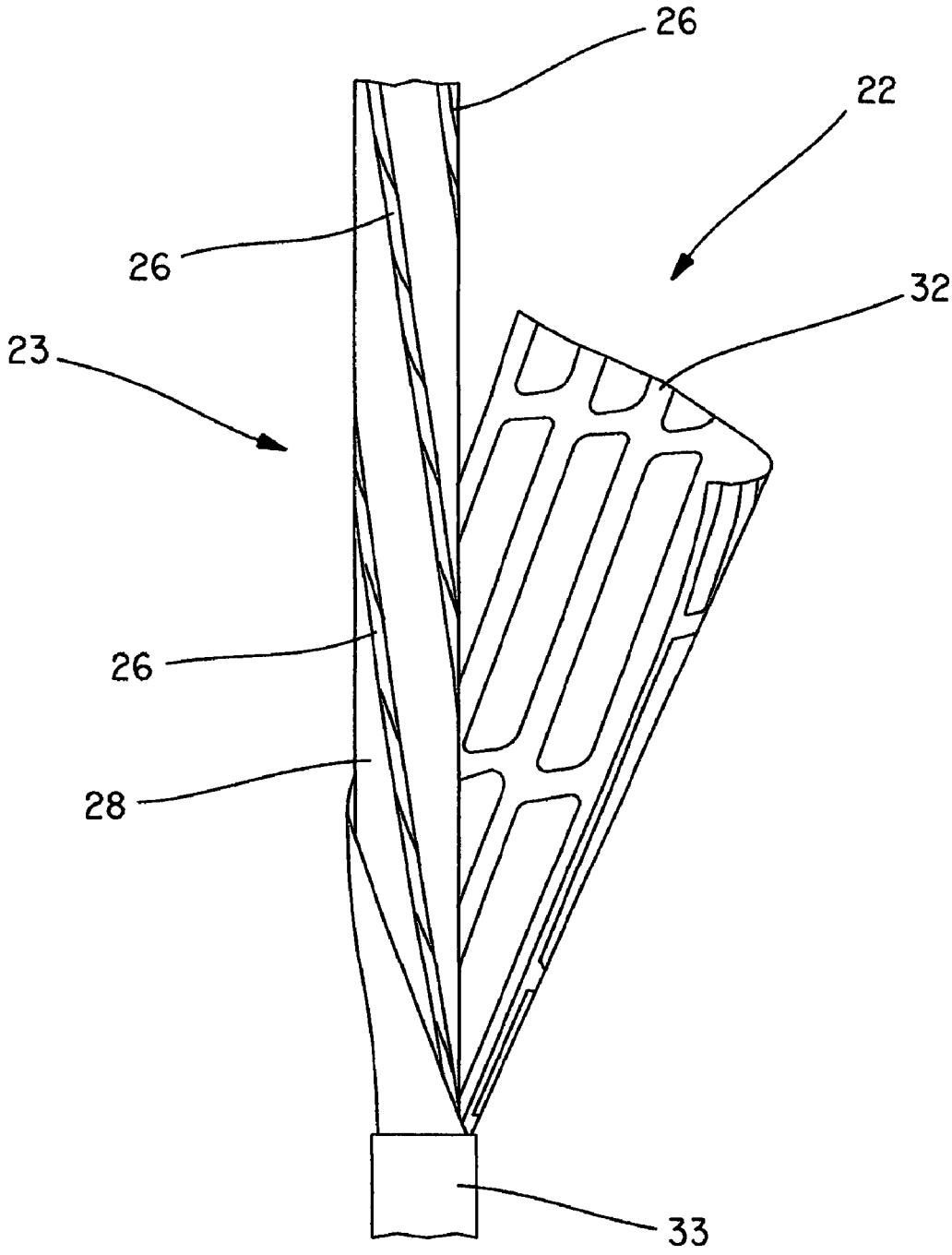
FIG. 5 is a perspective view of an embodiment of the cable of FIG. 1, illustrating the spiral nature of the barrier tape installed within the cable.

FIG. 5 is a fragmentary, perspective and partially exploded view of an embodiment of cable 22, illustrating the spiral nature of barrier tape 32 installed within cable 22. FIG. 5 illustrates how barrier tape 32 is spirally wound between crossweb 28 and outer jacket 33 of cable 22. Alternatively, the barrier tape can be applied around the crossweb 28 in a non-helical way (e.g., cigarette or longitudinal style). It is desirable for the helical wrapping of the barrier tape 32 to have a wrap rate approximately equal to the core lay length of the cable 22 (i.e., the rate at which the twisted pairs 26 of the cable wrap around each other, equivalent to the crossweb 28 wrap rate). However, in some embodiments the helical wrapping of the barrier tape 32 may have a wrap rate greater or less than the core lay length of the cable 22.

One of the design considerations of the present invention is constructing the barrier tape structure (such as conductive segments' dimensions, shape, spacing, quantity, number of rows and orientation) with respect to the effective twist rate (combined twist lay with cable lay) of each of the twisted pairs, to provide enhanced cable-to-cable coupling attenuation. If the relationship between the barrier tape structure and effective twist rate is not correct, the interval of the repeating pattern of the barrier tape in relation to the effective twist rate of each of the twisted pairs can create a strong coupling mechanism to adjacent cable(s) in various segments of the operating frequency spectrum of the channels, which is undesirable. The embodiment shown in FIGS. 1-5 is one combination, according to the present invention, which provides effective ANEXT and AFEXT attenuation up to 500 MHz. The present invention also provides high longitudinal impedance in the barrier tape which reduces or eliminates EMI susceptibility in comparison to the performance of known UTP cable.

Barrier tapes according to the present invention can be spirally, or otherwise, wrapped around individual twisted pairs within the cable to improve crosstalk attenuation between the twisted pairs. Further, barrier layers according to the present invention may be incorporated into different structures within a cable, including an insulating layer, an outer insulating jacket, or a twisted-pair divider structure.

From the foregoing, it can be seen that there have been provided features for improved performance of cables to increase attenuation of cable-to-cable crosstalk. While particular embodiments of the present invention have been shown and described, it will be obvious to those skilled in the art that changes and modifications may be made without departing from the invention in its broader aspects. Therefore, the aim is to cover all such changes and modifications as fall within the true spirit and scope of the invention. The matter set forth in the foregoing description and accompanying drawings is offered by way of illustration only and not as a limitation.

The invention claimed is:

1. A cable comprising:

a plurality of twisted pairs of conductors comprising a cable core; and a barrier tape substantially surrounding said cable core, said barrier tape comprising:

an insulating substrate;

a first barrier layer of conductive segments separated by in both a longitudinal and a circumferential direction of the cable such as to prevent any individual segment from traversing an entire length or entire circumference of the communication cable; and a second barrier layer of conductive segments separated by gaps in both a longitudinal and a circumferential direction of the cable such as to prevent any individual segment from traversing an entire length or entire circumference of the communication cable;

wherein the conductive segments of said first and second barrier layers are parallelogram-shaped.

2. The cable of claim 1 further comprising a crossweb separating said twisted pairs from one another.

3. The cable of claim 2 wherein said crossweb comprises a central section that separates said twisted pairs from one another and perimeter sections that separate said twisted pairs from said barrier tape.

4. The cable of claim 1 wherein said barrier tape is helically wrapped around said cable core.

5. The cable of claim 4 wherein said cable core is twisted within said cable at a twisted cable strand lay length and further wherein said barrier tape is helically wrapped around said cable core at a barrier wrap length that is the same as said cable strand lay length.

6. Cable of claim 1 wherein said conductive segments of said first and second barrier layers overlay each other in a pattern such that gaps in one of the two layers are substantially covered by conductive segments in the other of the two layers.

7. The barrier tape of claim 1 wherein said parallelogram-shaped conductive segments have a pitch of approximately 15 degrees.

8. The barrier tape of claim 1 wherein said parallelogram-shaped conductive segments have rounded corners.

9. The barrier tape of claim 1 wherein said parallelogram-shaped conductive segments have lengths of from approximately 1.3 cm to approximately 10 cm.

10. The barrier tape of claim 1 wherein said parallelogram-shaped conductive segments are comprised of a material selected from the group consisting of aluminum, copper, gold, and nickel.

11. A barrier tape for wrapping a core of twisted pairs of conductors in a communication cable, thereby attenuating alien crosstalk, said barrier tape comprising:

an insulating substrate;

a first barrier layer of conductive segments separated by gaps in both a longitudinal and a circumferential direction of the cable such as to prevent any individual segment from traversing an entire length or entire circumference of the communication cable; and a second barrier layer of conductive segments separated by gaps in both a longitudinal and a circumferential direction of the cable such as to prevent any individual segment from traversing an entire length or entire circumference of the communication cable;

wherein the conductive segments of said first and second barrier layers are parallelogram-shaped.

12. The barrier tape of claim 11 wherein said conductive segments of said first and second barrier layers overlay each other in a pattern such that gaps in one of the two layers are substantially covered by conductive segments in the other of the two layers.

13. The barrier tape of claim 11 wherein said parallelogram-shaped conductive segments have a pitch of approximately 15 degrees.

14. The barrier tape of claim 11 wherein said parallelogram-shaped conductive segments have rounded corners.

15. The barrier tape of claim 11 wherein said parallelogram-shaped conductive segments have lengths of from approximately 1.3 cm to approximately 10 cm.

16. The barrier tape of claim 11 wherein said parallelogram-shaped conductive segments are comprised of a material selected from the group consisting of aluminum, copper, gold, and nickel.

17. The barrier tape of claim 11 wherein said parallelogram-shaped conductive segments have a thickness of approximately 0.35 mils.

18. The barrier tape of claim 11 wherein said conductive segments are attached to said insulating substrate by a glue layer.

19. The barrier tape of claim 18 wherein said glue layer is approximately 0.5 mils thick.

* * * * *